United States Patent [19]

Langenbahn

[11] Patent Number: 4,850,879

[45] Date of Patent: Jul. 25, 1989

[54] DRIVE-UP ELECTRICAL RECEPTACLE

[76] Inventor: Albert E. Langenbahn, 704 S. Morgan, Mason City, Ill. 62664

[21] Appl. No.: 242,665

[22] Filed: Sep. 12, 1988

[51] Int. Cl.[4] ..... H01R 13/62

[52] U.S. Cl. ..... 439/10; 439/34; 439/247; 439/342; 439/840; 439/699; 320/2

[58] Field of Search ..... 439/10, 11, 34, 247, 439/338, 342, 343, 341, 626, 660, 676, 699, 840, 841, 817, 245; 320/2; 403/13, 14

[56] References Cited

U.S. PATENT DOCUMENTS 3,111,355 11/1963 Samburoff et al. ..... 439/159
3,513,434 5/1970 Zielke ..... 439/840
4,795,358 1/1989 Lyles ..... 439/247

FOREIGN PATENT DOCUMENTS 277350 12/1969 German Democratic Rep. ..... 439/817

*Primary Examiner*—Gary F. Paumen
*Attorney, Agent, or Firm*—Edwin E. Greigg

[57] ABSTRACT

A quick connect drive up receptacle which includes a receptacle supported by spaced arms. An adjustable spring supports the spaced arms so that the receptacle is held at a desired height. Male connectors on the vehicle are so configured that the arm supported receptacle will engage the male connectors to supply current to one or more devices on or in the vehicle.

18 Claims, 3 Drawing Sheets

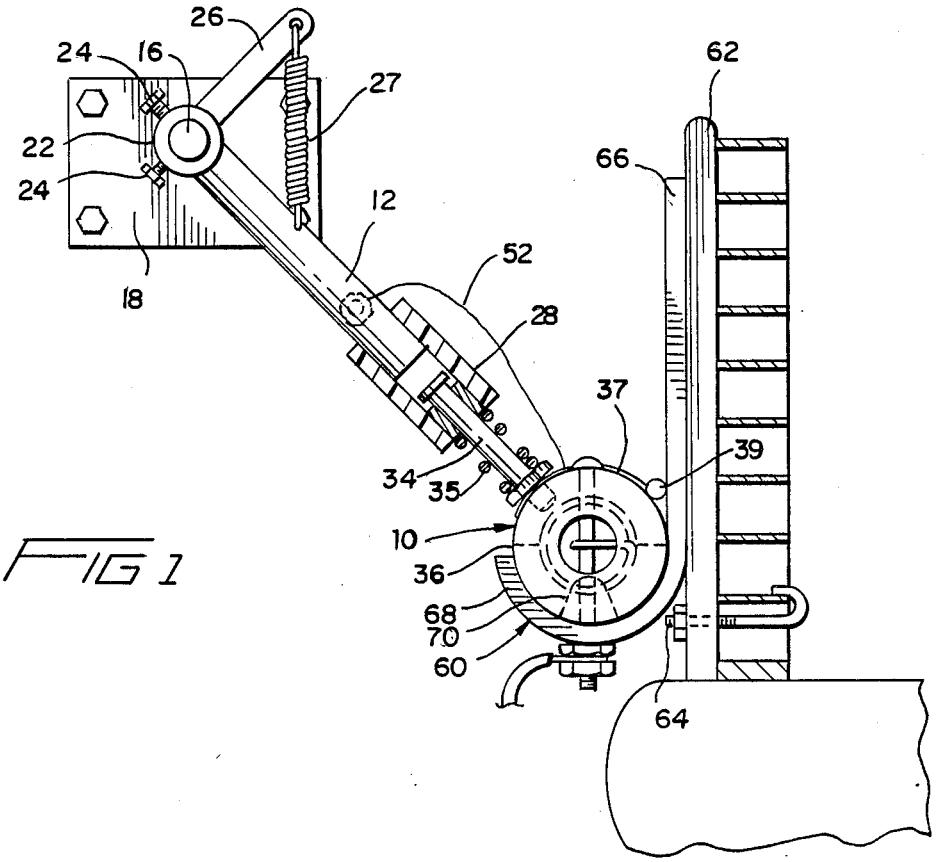
FIG 1
FIG 2
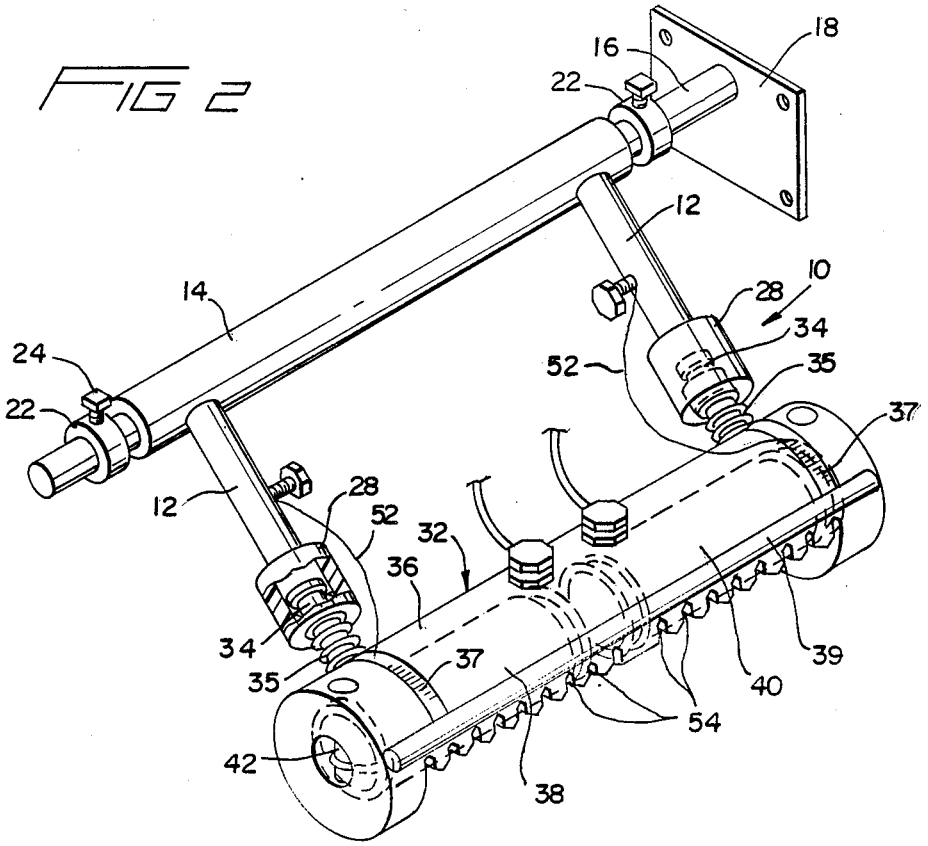

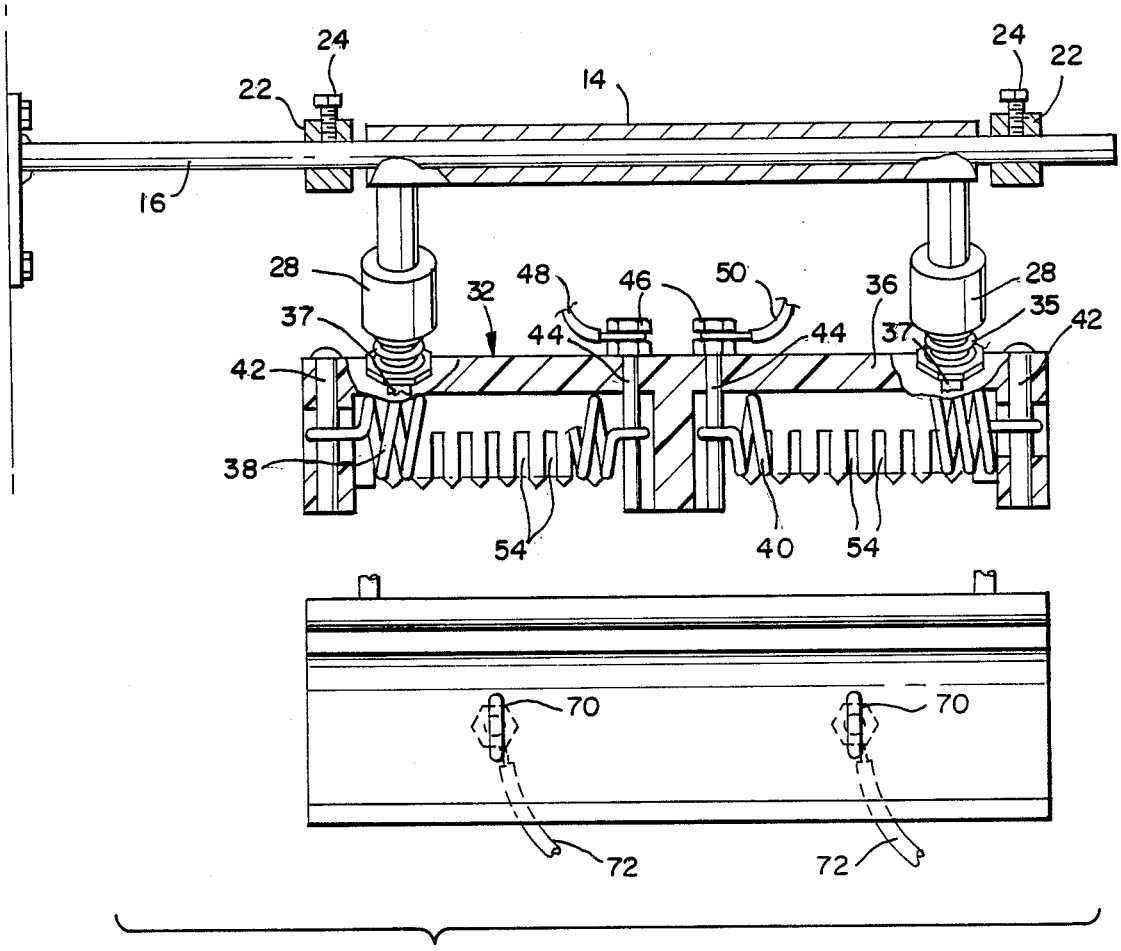
FIG 3
FIG 5
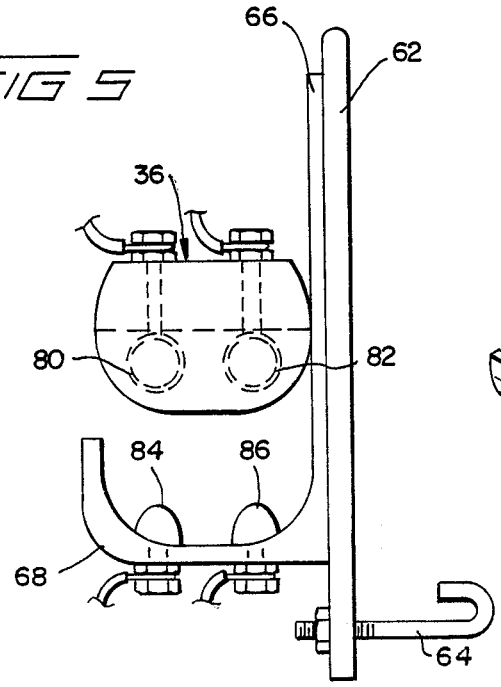
FIG 4
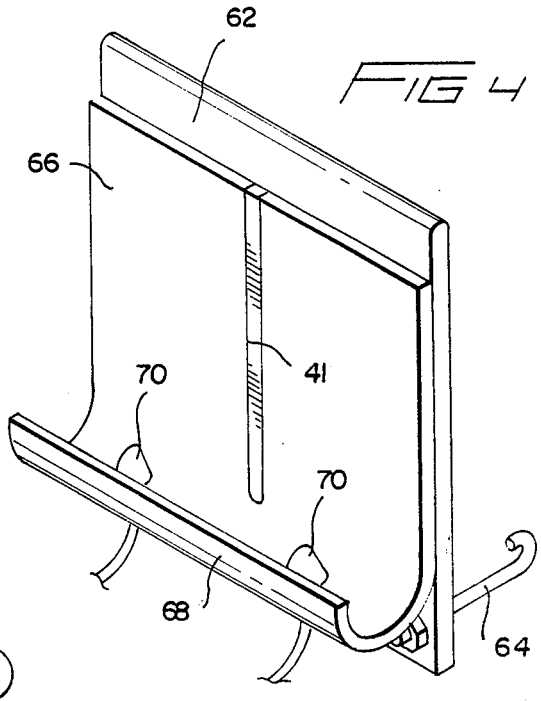

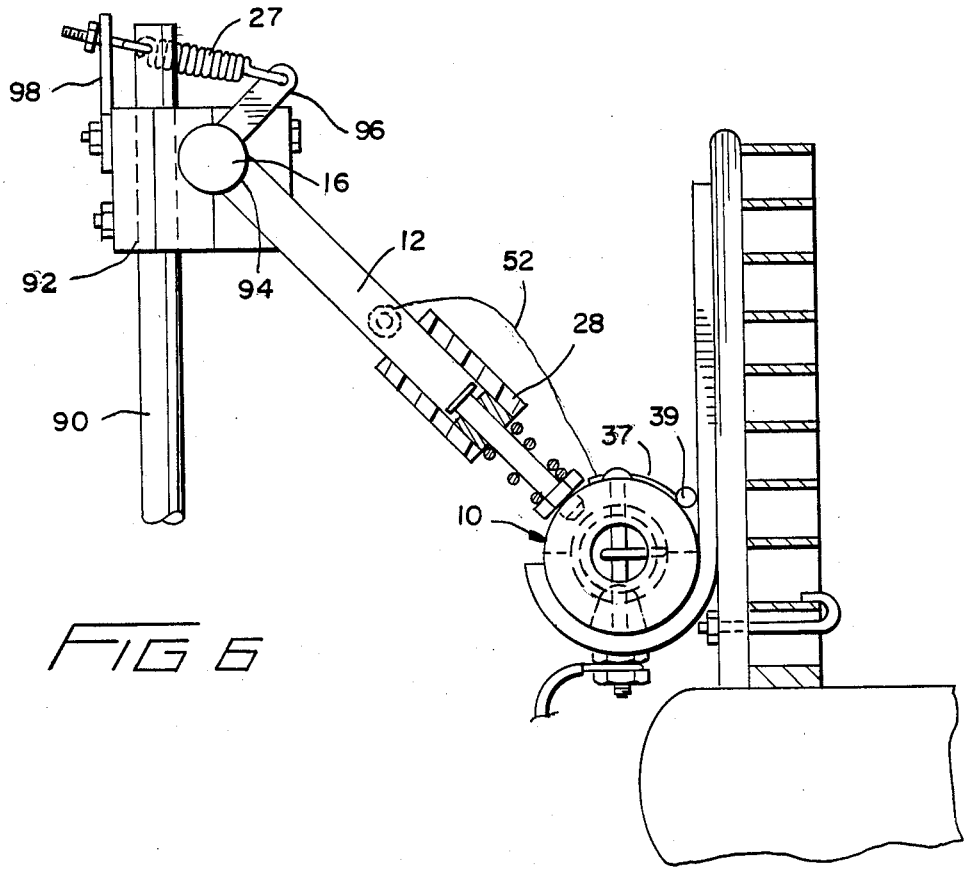
FIG 6
FIG 7
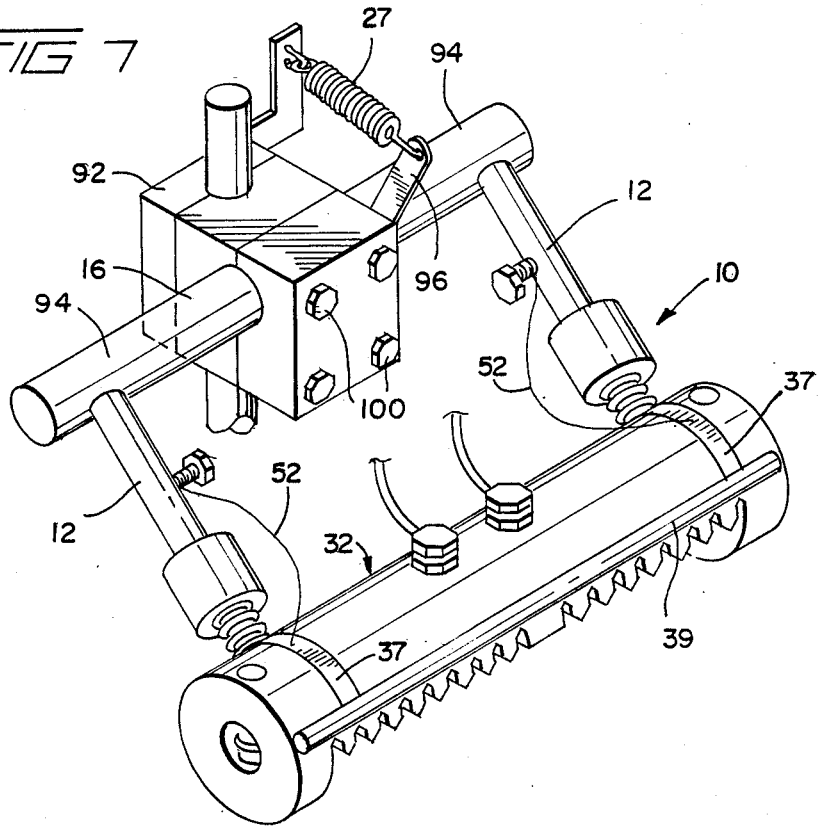

DRIVE-UP ELECTRICAL RECEPTACLE

BACKGROUND OF THE INVENTION

This invention is directed to an electric receptacle and more particularly to an electrical receptacle to which a vehicle may be connected for supplying electrical energy to a desired heater or other element in the vehicle.

Heretofore various electrical supply systems have been used for supplying electrical energy to a device in or on a vehicle. Such systems include oil heaters, engine heaters, window defrosters, mirror heaters, interior heaters, etc., to which energy is supplied by an outside line connected to the heating device. It is well known in northern regions where it is extremely cold which makes starting vehicle engines very difficult, to have coil operated power supplies on convenient posts or alongside buildings to which an electrical lead may be connected for heating the engine prior to starting the engine. The same applies for defrosting windows as well as heating other areas of the vehicle.

It is therefore an object to provide a drive up electrical receptacle to which a vehicle may be automatically electrically connected to provide an electrical supply for a desired use.

Another object is to provide an electrical connector which can be automatically connected to eletrical conductors fixed in place on the vehicle.

Yet another object is to provide an electrical receptacle which supplies electrical energy to feed lines that lead to any number of conventional receptacles within or on the vehicle body, engine compartment, dash, etc.

The invention will be better understood and further objects and advantages thereof will become more apparent from the ensuing detailed description of preferred embodiments taken in conjunction with the drawings.

BRIEF DESCRIPTION OF THE DRAWINGS

FIG. 1 is a side view of a drive up receptacle engaging male conductors of contact holders shown secured to a grill of a vehicle and supported by the bumper.

FIG. 2 is a perspective view illustrating the supporting arms for the receptacle.

FIG. 3 is a front view of the supporting arms and receptacle.

FIG. 4 is a perspective view of the contact holders secured to the vehicle more clearly illustrating the contacts;

FIG. 5 illustrates a two circuit receptacle connector; and

FIGS. 6 and 7 illustrate the drive-up receptacle as shown in FIGS. 1 and 2 supported by a pole.

DETAILED DESCRIPTION

Now referring to the drawings there is shown a side view of a receptacle made in accordance with the teaching of this invention. As shown, the receptacle 10 is supported by spaced arms 12 which extend from a tube 14. The tube 14 is rotatable about a rod 16 which is secured to a plate 18 which is secured to a wall or any other support structure from which the rod extends. The rod could extend from side-to-side of a garage or other support and be supported at each end for greater strength. The tube 14 is rotatable on the rod and as such can be fixed at any desired position along the length of the rod by use of tubular fittings 22 which fits over the rod 16 and are secured in place by a screw or bolt 24 threaded through the fitting against the rod 16. One of the fittings may include a bracket or arm extension 26. The angle of the arm extension may be adjusted relative to the rod by rotating the fitting and then securing the fitting in place by the bolt. A hard spring 27 is secured between arm 12 and the arm extension 26 to position the receptacle in place at a desired height. A flexible tubular member 28 is secured to the end of each arm 12 and the receptacle 32 is secured to the flexible member by use of bolts 34 with an enlarged end of the bolt within the flexible member to prevent the bolt from being pulled from the flexible member. A spring 35 is placed on the bolt between the end of the flexible tubular member and the receptacle to further absorb any force on the receptacle, when used.

The receptacle 32 is better shown in FIG. 3 which illustrates a cross sectional view as seen from the end. The receptacle 32 includes a somewhat semicircular housing 36 made of electrically non-conductive material secured to the flexible members 28 by the bolts 34.

Elongated electrical conductors or electrodes 38 and 40 in the form of coil springs extend from the outer end of the housing 36 toward a center spacer. The outer ends of the conductors are secured to bolts 42 that pass through the housing, and the inner ends of the conductors are also secured to bolts 44 that pass through the housing. The bolts 44 are provided with insulator fasteners 46 on their outer ends and the electrical supply conductors 48 and 50 are secured to the bolts to provide electrical energy to the elongated coil spring conductors. A ground wire 52 may be connected to the support bolt and to the support arm 12 in order to insure that the receptacle is grounded to the male connector 60. The bolts 34 may secure conductor strips 37 in place to which a conductor rod 39 is secured between the conductor strips 37. Thus, in use, the rod will contact a conductor 41 on the male connector which is grounded to the body-frame of the vehicle by ground. Thus, the vehicle will be grounded to the receptacle. The linear open edges of the housing 36 are formed with teeth 54 which permit the male electrodes to pass through the teeth to the coil contacts. Also the ends of the housing may be provided with end caps to prevent touching the ends of the conductor coils 38, 40.

Male connector 60 is secured to the front of a vehicle such as the grill above the bumper so that the connector 60 is supported by the bumper. The connector 60 includes a backing support 62, which is connected to the grill or other structure on the front end of the vehicle by use of J-bolts 64 or any other suitable means. A flat piece of insulating material 66 having a semicircular end 68 directed away from the grill is secured to the support 62. Male electrodes 70 pass through the center extension of the semicircular end and are connected to supply conductors 72 which feed an electrical source to a desired device in or on the vehicle. The ground wire 52 may be connected to the support and to the grill for grounding purposes.

The male electrodes 70 that connect with the coil conductors are flat in cross section and somewhat semicircular in shape across the width of one end so that the male electrodes 70 can easily fit between the coils of the coil conductors 38, 40. The male electrodes 70 are spaced apart a distance which is greater than the length of each of the coil conductors 38, 40 so that the male electrodes 70 are sure to contact both coil conductors to complete the electrical circuit.

It would be obvious to one skilled in the art that the body-frame of the vehicle may be used as the ground. In this event, one of the male conductors 70 may be grounded to the body frame and the ground wire of the input supply of the receptacle is connected to the coil conductor to which the grounded male conductor is to make contact. Thus, the device to which the electrical supply is furnished would be grounded to the body-frame.

In use, the spring supporting arm will be adjusted so that the receptacle housing is at a height to clear the end of the semicircular end of the male connector on the vehicle. The electrical supply to the receptacle is provided with a switch so it could be switched on for use, and it could be coin operated. One example of use is as follows. The supply source to the receptacle is switched off. The vehicle to use the supply is driven toward the receptacle until the receptacle housing touches the male connector. A slight forward movement will move the receptacle downward due to its circular shape until the male electrodes enter between the coils to make contact. The vehicle will be turned off. After a period of time has elapsed and it is desired to start the engine, warm the inside, warm the seats, etc., the current is turned on to the receptacle. The supply will flow through the receptacle to the male electrodes and via the supply conductors 72 to the desired device in or on the vehicle. There may be times of extreme cold that the engine, etc., is to remain warm; therefore the current supply to the vehicle will remain on and the vehicle will be ready to go instantly without a delay for warming the engine, etc.

In consideration of the above as to whether the current supply should remain on or is to be turned on at a particular time, the receptacle and male conductor may be made with two sets of contacts 80, 82, and 84, 86, so that one set of contacts could be switched on for constant use whereas the other set of contacts may be controlled by a timer. The timer would complete the circuit at a desired time so that in such a situation the engine could be kept warm all the time and some other device or devices heated for only a short period of time before it is ready for use.

FIGS. 6 and 7 illustrate a drive-up receptacle 10 such as shown in FIGS. 1 and 2 supported on a pole 90 by a block adapter 92 which could be erected in a parking lot, alongside a building or at any other suitable place. The block adapter 92 may be provided with an aperture which fits over the pole 90 and is held in place by lock bolts or the block may be split into at least two pieces to fit about the pole 90 and is secured about the pole by use of bolts 100. With either type adapter, the receptacle supporting rod or tube 94 is slide through an aperture in the adapter 92 and then the arms 12 are secured thereto on each side of the adapter so that the rod or tube 94 rotates freely within the adapter.

As shown in FIGS. 6 and 7, the arm 96 is secured to the rod or tube 94 and the hard spring 27 is secured to one end of the arm 96 and to a bracket 98 which is secured to the adapter 92. Therefore the spring will hold the receptacle 10 in place for contact with the male connector 60. The adapter may be supported at any suitable position on the pole 90. The adapter could be made in three pieces so that the adapter may fit around the pole 90 and also around the rod or tube 94. In this way, the receptacle arms 12 and rod or tube 94 could be secured together and then secured in the adapter 92 for rotation within the adapter. The adapter could act as a bearing or a sleeve bearing could be used in the adapter for the rod 94. Means may be provided on each side of the adapter for centering the drive up receptacle on the adapter 92.

The illustrations shown by example in FIGS. 1–7 are suggested ways of securing the receptacle 10 in place. The rod could be secured at each end between two poles with the receptacle rotatable on the rod. Other ways will be obvious to one skilled in the art and will fall within the concepts of this invention.

The foregoing relates to preferred exemplary embodiments of the invention, it being understood that other variants and embodiments thereof are possible within the spirit and scope of the invention, the latter being defined by the appended claims.

What is claimed and desired to be secured By Letters Patent of the United States is:

1. A drive-up electrical receptacle for automatically supplying input power to a power line, which comprises:

a first elongated housing made of electrical insulating material, open on one side;

first and second elongated electrodes supported in said first elongated housing on the same axes, and separated from each other at one end;

spaced, spring loaded flexible holders which support said first housing;

first and second linear arms that support each of said spaced spring loaded flexible holders, each of said arms being pivotable about a rod; and an electrical supply line connected to each of said first and second elongated electrodes.

2. A drive-up electrical receptacle as set forth in claim 1, which includes:

a bracket supported by said rod, and a spring connected between said bracket and one of said arms which supports said arms and said first housing in a set position relative to a surface.

3. A drive-up electrical receptacle as set forth in claim 2, which includes:

means for securing said rod to a supporting surface with the rod parallel to a ground surface.

4. A drive-up electrical receptacle as set forth in claim 1, in which:

said first elongated housing includes spaced comb-like teeth along its open side.

5. A drive-up electrical receptacle for automatically supplying input power to a power line, which comprises:

a first elongated housing made of electrical insulating material, open on one side;

first and second elongated electrodes supported in said first elongated housing on the same axes, and separated from each other at one end;

an electrical supply line connected to each of said first and second elongated electrodes;

a second elongated housing made of electrically insulating material, open on one side;

first and second spaced electrodes extending outwardly from said second housing perpendicular to a linear axis of said second elongated housing, in which said first and second spaced electrodes are so positioned as to make electrical contact with said first and second elongated electrodes in said first electrical housing; and power lines connected to each of said spaced electrodes for feeding power to an operating device.

6. A drive-up electrical receptacle as set forth in claim 1, which includes:

spaced, spring loaded flexible holders which support said first housing.

7. A drive-up electrical receptacle as set forth in claim 6, which includes:

first and second linear arms that support each of said spaced spring loaded flexible holders, each of said arms being pivotable about a rod.

8. A drive-up electrical receptacle as set forth in claim 7, which includes:

a bracket supported by said rod, and a spring connected between said bracket and one of said arms which supports said arms and said first housing in a set position relative to a surface.

9. A drive-up electrical receptacle as set forth in claim 8, which includes:

means for securing said rod to a supporting surface with the rod parallel to a ground surface.

10. A drive-up electrical receptacle as set forth in claim 1, in which:

said first elongated housing includes spaced comb-like teeth along its open side.

11. A drive-up electrical receptacle as set forth in claim 5, in which:

said second housing is made of electrically insulating material and is J-shaped, said J-shaped housing is secured to a backing plate, and there is provided means for securing said backing plate to a front end of a vehicle with said J-shaped housing supported above a bumper on said vehicle.

12. A drive-up electrical receptacle as set forth in claim 6, in which:

said second housing is made of electrical insulating material and is J-shaped, said J-shaped housing is secured to a backing plate, and there is provided means for securing said backing plate to a front end of a vehicle with said J-shaped housing supported above a bumper on said vehicle.

13. A drive-up electrical receptacle as set forth in claim 7, in which:

said second housing is made of electrical insulating material and is J-shaped, said J-shaped housing is secured to a backing plate, and there is provided means for securing said backing plate to a front end of a vehicle with said J-shaped housing supported above a bumper on said vehicle.

14. A drive-up electrical receptacle as set forth in claim 8, in which:

said second housing is made of electrical insulating material and is J-shaped, a backing plate to which said J-shaped housing is secured, and means for securing said backing plate to a front end of a vehicle with said J-shaped housing supported above a bumper on said vehicle relative to a position of said first housing relative to said vehicle.

15. A drive-up electrical receptacle as set forth in claim 14, which includes:

a ground for electrically grounding said first housing relative to said supports, and a ground for electrically grounding said second housing relative to said vehicle.

16. A drive-up electrical receptacle as set forth in claim 15, in which said first and second elongated contacts are in the form of spring wire.

17. A drive-up electrical receptacle as set forth in claim 16, in which:

said first and second spaced electrodes are thin with one end semicircular in shape.

18. A drive-up electrical receptacle as set forth in claim 17, in which:

said J-shaped housing is provided with two pairs of spaced electrodes for supplying input power to two separate supply lines.

* * * * *